United States Patent [19]

Daw et al.

[11] Patent Number: 4,832,153

[45] Date of Patent: May 23, 1989

[54] ATTIC STAIR INSULATING COVER

[76] Inventors: Jesse M. Daw; Laraine B. Daw, both of Collingwood Estates, 201 Tina Ave., Pikeville, N.C. 27863

[21] Appl. No.: 200,508

[22] Filed: May 31, 1988

[51] Int. Cl.[4] ..... E06C 9/00; E04F 11/04

[52] U.S. Cl. ..... 182/46; 52/186

[58] Field of Search ..... 52/186, 184, 19, 200; 182/46, 47, 78; 206/321, 1.5

[56] References Cited

U.S. PATENT DOCUMENTS

| | | | |
|---|---|---|---|
| 4,281,743 | 8/1981 | Fuller | 182/46 |
| 4,299,064 | 11/1981 | Daniels | 52/35 |
| 4,312,423 | 1/1982 | Helbig | 182/46 |
| 4,671,026 | 6/1987 | Wissinger | 52/35 |

FOREIGN PATENT DOCUMENTS

| | | | |
|---|---|---|---|
| 959620 | 12/1974 | Canada | 52/186 |

*Primary Examiner*—Henry E. Raduazo
*Assistant Examiner*—Lan Mai
*Attorney, Agent, or Firm*—Rhodes, Coats & Bennett

[57] ABSTRACT

The present invention entails an attic stair insulating cover which can easily be placed in an operational position and a compact stored position. The insulating cover includes a plurality of pieces that when fitted together in the operational position form a cover in the shape of a rectangular box with four sides, a top and an open bottom that fits above and over an attic stair opening to provide a thermal barrier. The pieces of the insulating cover can also be disposed in the compact stored position with packaging materials used to even the shape of the cover in its stored position.

9 Claims, 2 Drawing Sheets

ATTIC STAIR INSULATING COVER

FIELD OF THE INVENTION

The present invention relates generally to an attic stair insulating cover for an attic stair opening and more specifically to an attic stair insulating cover which has an operational position and a compact stored position.

BACKGROUND OF THE INVENTION

Unpredictable and rising energy costs have caused an increasing number of energy conservation methods to become economically feasible. The public is increasingly investing in energy conservation means in order to reduce their energy consumption and cost. Improvements in energy conservation methods permit even more energy savings by the public.

A substantial amount of energy is lost from the living spaces of residences to the attic. Insulation throughout the attic is commonly used to reduce this energy loss to the attic, except at the area of the attic stair door. Heat is transferred through the thin piece of wood covering the attic stairs opening and through the cracks formed between the attic stair door and the adjacent ceiling. In order to reduce the energy loss through the area of the attic stair opening, a movable insulating cover can be used.

One type of insulation cover for an attic stair opening is a one-piece, rigid cover. The problem with this type of cover is the cover's size causes inconvenient and expensive storage, shipping, stocking, and packaging.

Another type of insulating cover for the attic stairopening is a non-rigid cover which is generally not as effective at reducing energy loss as a rigid cover and is more difficult to properly position over the attic stair opening.

An additional problem with the available attic insulating covers is the lack of a fire retardant coating to protect against the hazards of fires.

SUMMARY AND OBJECTS OF THE INVENTION

The attic stair insulating cover of the present invention overcomes these and other problems associated with prior art attic stair covers. The present invention is a detachable/attachable, rigid insulating cover with a fire retardant coating for an attic stairs opening, capable of assuming an operational position and a stored position.

The attic stair insulating cover is disposed its operational position by joining separate insulating cover pieces along respective edges to form a rectangular box with four sides, a top, and an open bottom. The bottom edges of the four sides are then placed above and around the attic stair opening on a base surrounding the attic stair opening. This provides an effective thermal insulation barrier above the attic stair opening.

The insulating cover pieces can also be detached and nestled together to place the cover in its compact stored position with packaging materials used to even the shape of the cover in its stored position. The attic stair insulating cover in its stored position entails a significantly reduced volume compared to the cover in its operational position.

Accordingly, it is an object of the present invention to provide a cover to effectively insulate an attic stair opening.

Another object of the present invention is to provide a lightweight movable cover for an attic stair opening.

Another object of the present invention is to provide a cover for an attic stair opening which can easily be disposed in both an operational position and a compact stored position.

Another object of the present invention is to provide a simple and efficient cover for an attic stair opening.

Another object of the present invention is to provide an easy to use cover for an attic stair opening.

Another object of the present invention is to provide a multi-piece attic stair opening insulating cover that can be easily broken down and packaged for convenient storage.

Another object of the present invention is to provide a safe, fire resistant cover for an attic stair opening.

Other objects and advantages of the present invention will become apparent and obvious from a study of the following description and the accompanying drawings which are merely illustrative of such invention.

DETAILED DESCRIPTION OF THE INVENTION

Figure 3:
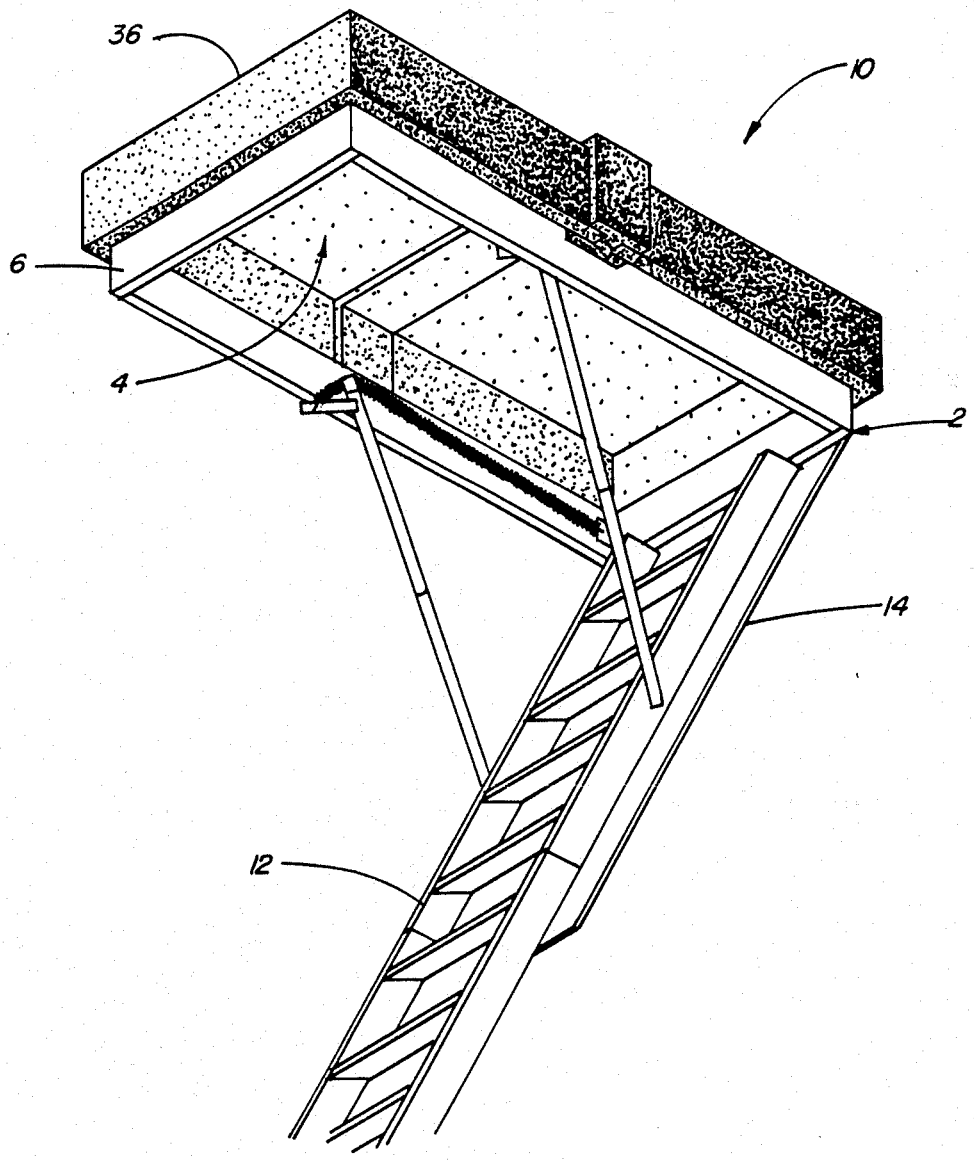
FIG. 3 is the attic stair insulating cover disposed in an operational position about an attic stair structure.

Referring now to the drawings, the attic stair opening insulating cover of the present invention is generally designated by the numeral 10, and is shown therein. As shown in FIG. 3, the attic opening insulating cover 10 is placed about an attic stair structure 2.

The attic stair structure 2, shown in FIG. 3, includes an attic stair opening 4, a base or frame 6 surrounding the attic stair opening 4, attic stair 12 accessing the attic stair opening 4, and an attic stair door 14 which covers the attic opening 4 when the attic stair structure 2 is closed.

Figure 1:
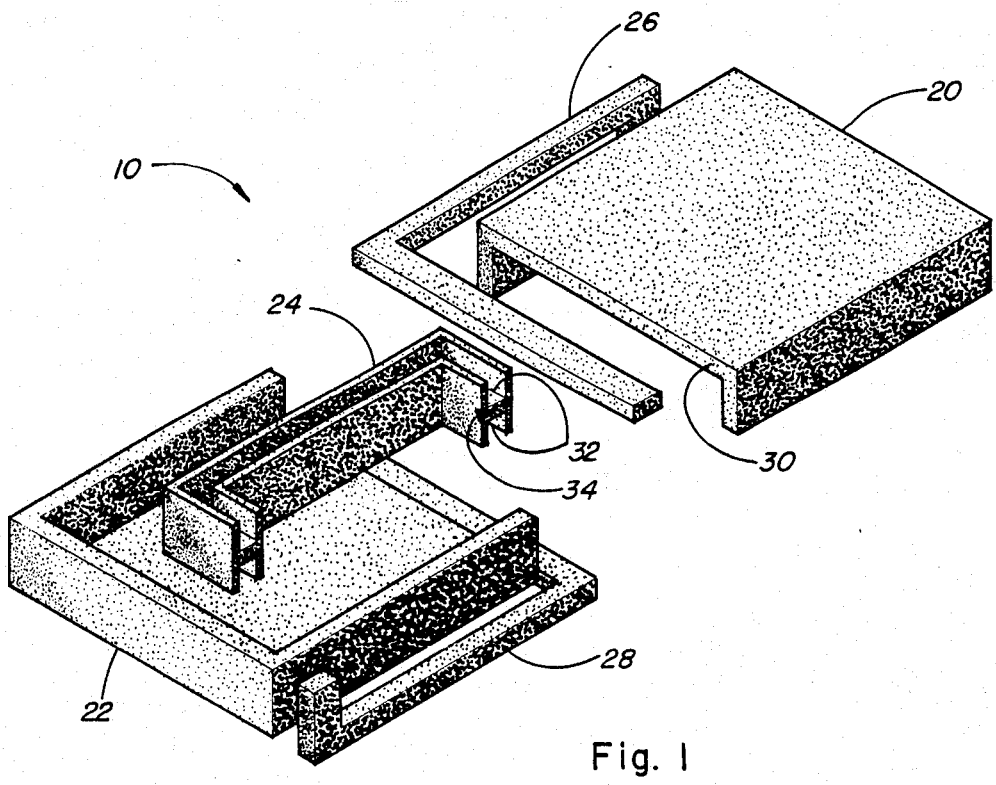
FIG. 1 is a segmented view of the attic stair insulating cover prepared to be placed in a stored position.

The attic stair insulating cover 10, preferably made of rigid foam or fiberglass, provides an insulation barrier around the attic stair structure 2. To help ensure safety, the attic stair insulating cover can be sprayed with fiberglass or other fire retardant material. The attic stair insulating cover 10, as shown in FIG. 1, includes a first half cover 20, a second half cover 22, a connector 24, a first packaging piece 26, and a second packaging piece 28.

The first half cover 20 and the second half cover 22 each form a partial box comprising three sides, a top, an open side, and an open bottom.

The connector 24 is in the shape of the open side edges 30 of the first half cover 20 and second half cover 22. The connector 24 has a groove 32 the size and shape of the open side edges 30 in each of its edges such that the connector's cross-section forms an "H" shape 34.

Figure 2:
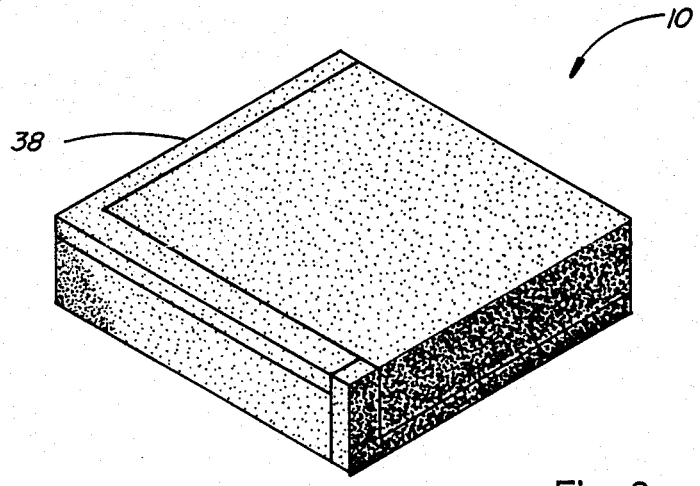
FIG. 2 is the attic stair insulating cover in a stored position.

The attic stairs insulating cover 10 has both an operational position 36, illustrated in FIG. 3, and a compact stored position 38, illustrated in FIG. 2.

The attic stairs insulating cover 10 is placed into its operational position 36, shown in FIG. 3, by attaching together with the connector 24 the first half cover 20 and the second half cover 22 along their open side edges 30. The open side edge 30 of the first half cover 20 fits into the groove 32 on one side of the connector 24, and the open side edge 30 of the second half cover 22 fits into the groove 32 of the opposite side of the connector 24. The connector 24 then holds the first half cover 20 and the second half cover 22 securely together to form a rectangular box with four side walls, a top and an open bottom.

The side edges facing the open bottom of the attic stair insulating cover 10 are then placed on the base 6 surrounding the attic stair opening 4. The four side walls of the attic stair insulating cover 10 are high enough such that the attic stair structure 2 in its closed position does not interfere with the position of the attic stair insulating cover 10. The weight of the attic stair insulating cover 10 and its contact at the base 6 hold the position of the attic stair insulating cover 10 when closing the attic stair door 14.

The attic stair insulating cover 10 also has a compact stored position 38. FIG. 1 shows the attic stair insulating cover 10 prepared to be placed in its final stored position 38, and FIG. 2 shows the final stored position 38. The first half cover 20 and the second half cover 22 are detached with the first half cover 20 inverted with respect to the second half cover 22. The first half cover 20 and the second half cover 22 are nestled together to form the shape of a rough closed box. The nestled position is such that the inside surface of one of the side walls of the first half cover 20 is adjacent to the outside surface of one of the side walls of the second half cover 22, and the side walls parallel to said side walls of first half cover 20 and second half cover 22 are at a congruent position. The connector 24 is stored within the cavity formed by this stored position 38. The stored position 38 only requires roughly one-half the volume of the operational position 36 of the attic stair insulating cover 10.

A first packaging piece 26 and a second packaging piece 28 is used to even the shape of the stored position 38 of the attic stair insulating cover 10, as shown in FIG. 2 and FIG. 3. The first packaging piece 26 comprises a rectangular shaped piece extending along the top edge facing the open side of the first half cover 20, then the first packaging piece 26 forms a right angle and extends along the outside surface of a side wall of the first half cover 20, and then forms another right angle and extends to the edge of the said side wall facing the open bottom. The second packaging piece 28 is also a rectangular shaped piece congruently positioned along the second half cover 22. Tape, glue, or similar adhesive means is used to attach the first packaging piece 26 and the second packaging piece 28 to the first half cover 20 and the second half cover 22 when the attic stair insulating cover 10 is in the stored position 38.

The present invention of the attic stair insulating cover 10 can also be designed with more than two attachable/detachable insulating cover pieces and with various connecting means for these pieces. For example, an alternate, integral connecting means of the first half cover 20 and second half cover 22 includes a lip on the open side edge 30 of the first half cover 20 which fits into a groove on the open side edge 30 of the second half cover 22. This secures the first half cover 20 and the second half cover 22 firmly together.

The present invention may, as indicated, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. An attic stair opening insulating cover including:

(a) a plurality of attachable and detachable insulating cover pieces;

(b) means for attaching the insulating cover pieces in an operational position so as to form an insulating cover with four sides, a top, and an open bottom which fits over an attic stair opening;

(c) means for disposing the insulation cover pieces in a compact stored position;

(d) a first packaging piece of rectangular shape extending along the top edge facing the open side of the first half cover, then forming a right angle and extending along the outside surface of a side wall of the first half cover, and then forming another right angle and extending to the edge of the said side wall facing the open bottom; and, (e) and a second packaging piece with a congruent shape essentially the same as the first packaging piece and congruently positioned along the second half cover; and a means for attaching the packaging pieces to the half covers.

2. The insulating cover of claim 1 wherein the plurality of attachable and detachable insulating cover pieces includes:

(a) a first half cover and a second half cover which each form a partial box comprising three sides, an open side, and an open bottom; and (b) means for attaching in an operational position the first and second half covers at their congruent open side edges so as to form a cover with four sides, a top, and an open bottom which fits over an attic stair opening.

3. The insulating cover of claim 1 wherein the means for attaching the first and second half covers includes an attachable and detachable connector in the general shape of the open side edge of the half covers; the connector containing a groove in each of its edges roughly the size and shape of the open side edge of the half covers such that the connector's cross-section forms an "H" shape; the connector's shape and grooves permit the open side edge of first half cover to fit into the groove of one edge of the connector and the open side edge of the second half cover to fit into the groove of the opposite edge of the connector; and wherein the two half covers are held together by the connector.

4. The cover of claim 2 wherein the cover can be placed in a compact stored position such that:

(a) the first and second half covers are detached;

(b) one half cover is inverted with respect to the other half cover;

(c) the two half covers are nestled together to form the shape of a rough, closed box; and wherein the nestled position is such that the inside surface of one of the side walls of the inverted half cover is adjacent to the outside surface of one of the side walls of the non-inverted half cover; and wherein the side walls parallel to said side walls of inverted and non-inverted half covers are at a congruent position such that a compact box with four sides, a top, and a bottom are formed.

5. The cover of claim 4 wherein the means for attaching the two half covers together in the operational position can be stored within the cavity formed by the cover in its stored position.

6. The cover of claim 1 wherein the cover is made of a foam insulating material.

7. The cover of claim 1 wherein the cover is made of a fiberglass insulating material.

8. The cover of claim 1 wherein the cover is sprayed with a fire retardant material.

9. The stored position of claim 4 wherein packaging materials are used to form a more even box when the cover is in its stored position.

* * * * *